US006464475B1

(12) United States Patent
Bertolini

(10) Patent No.: US 6,464,475 B1
(45) Date of Patent: Oct. 15, 2002

(54) HEAD FOR PUMPS IN PARTICULAR OF THE MEMBRANE OR PISTON TYPE AND METHOD FOR ITS MANUFACTURE

(75) Inventor: Mario Bertolini, Bibbiano (IT)

(73) Assignee: Idromeccanica Bertolini S.p.A., Reggio Emilia (IT)

( * ) Notice: Subject to any disclaimer, the term of this patent is extended or adjusted under 35 U.S.C. 154(b) by 0 days.

(21) Appl. No.: 09/544,295

(22) Filed: Apr. 6, 2000

(51) Int. Cl.[7] ..... F04B 19/00
(52) U.S. Cl. ..... 417/437
(58) Field of Search ..... 417/437, 569, 417/571; 42/169.2

(56) References Cited

U.S. PATENT DOCUMENTS 4,817,503 A * 4/1989 Yamada ..... 92/98
5,533,886 A * 7/1996 Von Der Heyde et al. ..... 418/1
5,676,531 A * 10/1997 Muscarella et al. ..... 417/413.1

* cited by examiner

*Primary Examiner*—Teresa Walberg
*Assistant Examiner*—Vinod D Patel
(74) *Attorney, Agent, or Firm*—Browdy and Neimark, P.L.L.C.

(57) ABSTRACT

A head for pumps in particular of the membrane or piston type used for watering and weeding, and to the method for its manufacture. The head has an internal metal frame able to provide it with mechanical strength, integrated in a structure made of material able chemically to withstand the pumped liquids.

4 Claims, 2 Drawing Sheets

HEAD FOR PUMPS IN PARTICULAR OF THE MEMBRANE OR PISTON TYPE AND METHOD FOR ITS MANUFACTURE

BACKGROUND OF THE INVENTION

The present invention relates to a head for pumps in particular of the membrane or piston type and to a method for its manufacture, the pump being destined for use with fluids in general and, specifically, for watering and weeding.

The pumped liquid is thus generally constituted by an aqueous solution, made aggressive both by the presence of inorganic and organic electrolytes, and by the presence of solid substances in suspension, for instance crystalline substances, or inert sands.

The head is the main and most stressed component of a membrane or piston pump for fluids and must be such as to withstand chemically all pumped fluids, and mechanically the pulsating pressure due to the alternation of intake and delivery.

To meet such requirements, heads obtained with different manufacturing technologies are known.

In particular, known heads are made of brass by press forging, or of bronze by casting, or of aluminum by press forging or casting and possibly with superficial protection for instance through superficial anodizing, or through superficial coating made of thermoplastic material (plasticizing), or through spray painting.

Aluminum alloy heads have poor chemical resistance to the pumped products, especially weed killers and pesticides. Even superficial coatings constituted by a plastic film do not provide the necessary assurance both in terms of duration and actual efficiency, since such coatings peel off with use, are permeable to liquids by porosity, and are difficult to manage and control in terms of quality.

Cast or press forged heads made of copper alloys (bronze and brass) not only have poor chemical resistance but also high manufacturing costs.

Also known are heads made of thermoplastic resins, possibly with metal inserts in the fastening and anchoring points (threaded bushings). In this case, the problem of chemical resistance is solved but the heads thus obtained have insufficient mechanical and structural resistance; even the provision of metal inserts fails to solve the problem of the warping of the structure under the action of pressure and screw tightening.

The particular cyclical mechanical stress whereto the head is subjected causes the onset of fatigue yielding in the thermoplastic material, thus limiting the working life of the piece.

Heads made of cast iron by casting or of stainless steel by casting or press forging not only have low chemical resistance, but are also difficult to manufacture.

SUMMARY OF THE INVENTION

The aim of the present invention is to eliminate the aforesaid drawbacks and to make available a head for alternating pumps with high chemical and mechanical resistance, with the possibility of using the aforesaid invention for pumps with higher pressures, used in industries such as the chemical, agriculture and food production, plant husbandry, for acids and liquefied gases.

Said aims are fully achieved by the head for pumps in particular of the membrane or piston type and method for its manufacture, constituting the subject of the present invention, which is characterized by the contents of the claims set out below.

In particular the aforesaid head comprises a frame able to provide mechanical strength, integrated in a structure made of a material able to withstand the pumped liquids chemically. The head is obtained by means of a method characterized in that it comprises the positioning of the frame on appropriate references inside a moldbefore injecting thermoplastic material constituting the exterior structure of the head.

BRIEF DESCRIPTION OF THE DRAWINGS

This and other features shall become more readily apparent from the following description of a preferred embodiment illustrated, purely by way of non limiting example, in the accompanying drawing tables, in which.

DESCRIPTION OF THE PREFERRED EMBODIMENT

Figure 1:
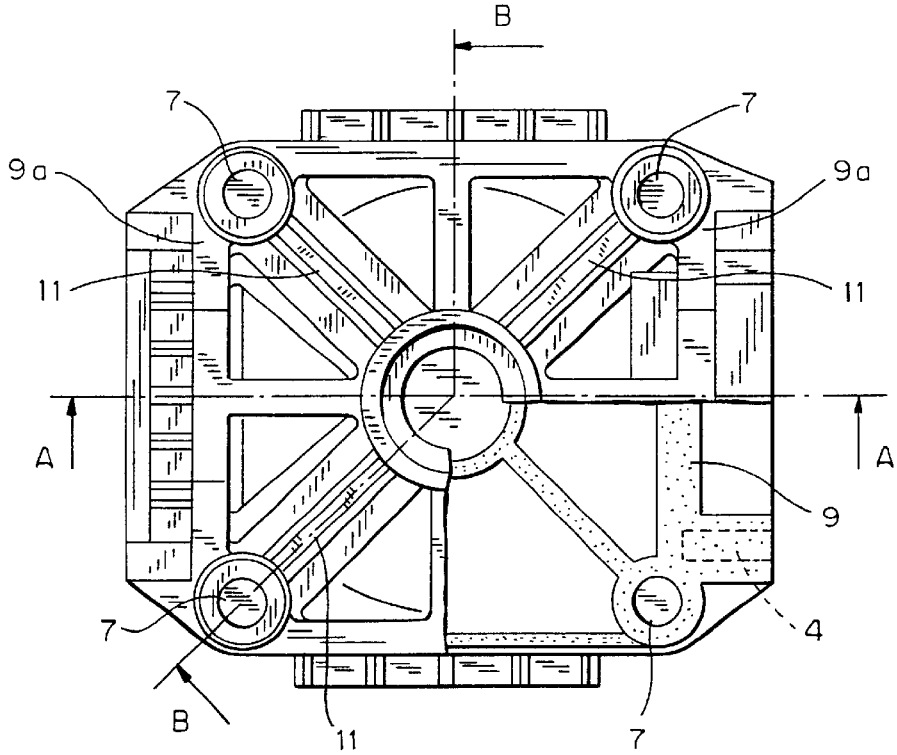
FIG. 1 hows a top view of a head.
Figure 2:
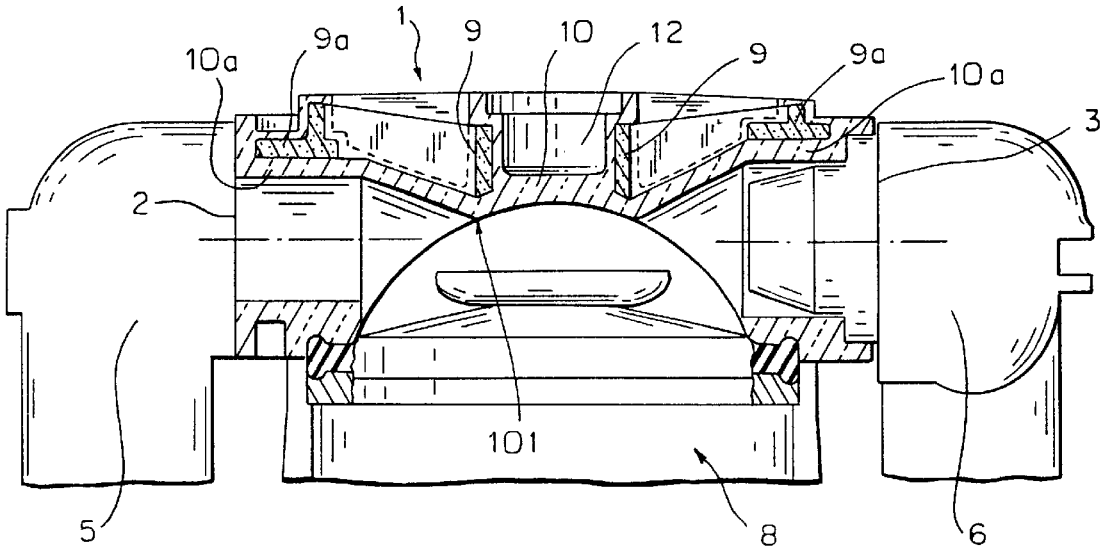
FIG. 2 rows a section along the straight line A—A of FIG. 1.

With reference to the figures, the number 1 globally indicates a head for fluid pumps, in particular of the alternating membrane type used specifically for watering and weeding.

The head 1 comprises an inlet section 2 and an outlet section 3 for the entry and exit of the pumped fluid, with points (bosses) 4 for attaching said sections respectively to an intake manifold 5 and a delivery manifold 6.

On the head 1 are also provided fastening elements (cylinder frustum shaped bushings) 7 able to secure the bead on a known base 8.

The head 1 is originally constituted by two mutually integrated components. It comprises a metal frame 9 able to provide mechanical strength, integrated and incorporated in a structure 10 made of injectable plastic material, able chemically to withstand the pumped liquids.

The frame 9 is preferably made of die-cast aluminum alloy and comprises the attachment points (screw bosses) 4 of the intake and delivery manifolds 5 and 6, and the elements (bushings) 7 for fastening the header 1 to the case 8, the attachment points 4 being integrally connected to the fastening elements 7 by means of metal ribs 11 and a semitubular portion 9*a*, also comprised in the frame 9.

Figure 3:
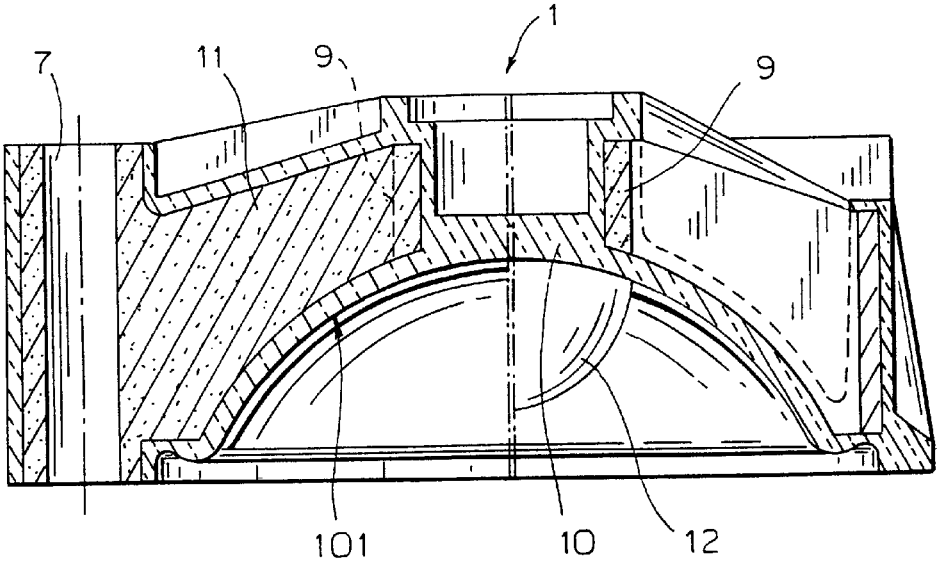
FIG. 3 hows a section along the path B—B of FIG. 1.
Figure 4:
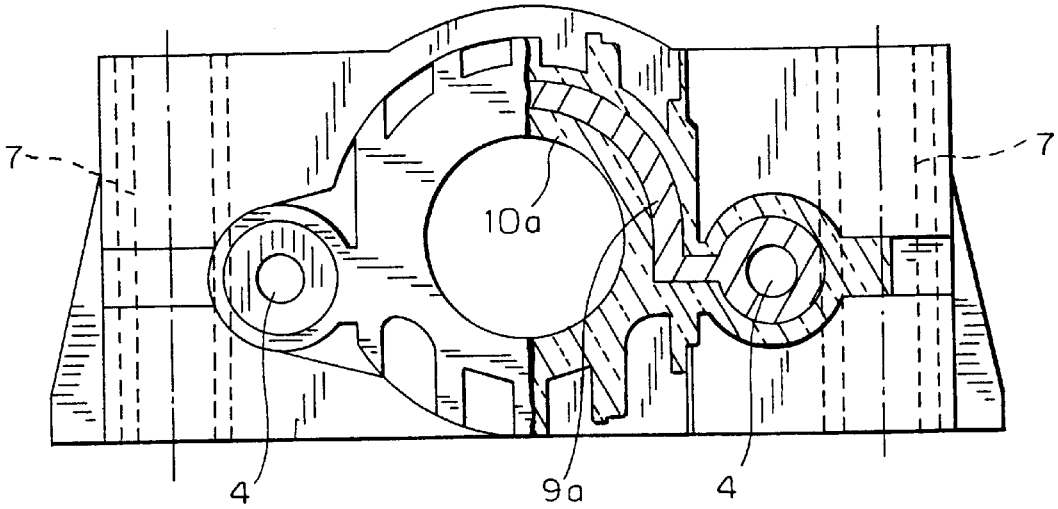
FIG. 4 shows a front view of the head in correspondence with an inlet section, partially sectioned.

Such metal ribs 11 provide the frame 9 with particular stiffness, being obtained with ribbings fixed for their full height in the fastening elements 7, as shown in FIG. 3.

The structure 10 is made of molded thermoplastic material with a tubular portion 10*a* so that the frame 9 is completely integrated into the structure itself, with the sole exception of the attachment points 4 and of the fastening elements 7 whose extremity projects outside the structure 10.

The method for manufacturing a head 1 for fluid pumps comprises a first phase in which a metal frame 9 is obtained, such metal frame 9 comprising points (bosses) 4 for the attachment of intake and delivery manifolds 5 and 6, and elements (bushings) 7 for fastening the head 1 to a known base 8. In the case of the head shown in the figure, the frame 9 is made of die-cast aluminum alloy, with ribs 11 and the semitubular portion 9*a* able to provide resistance against flexion and warping as a result of pressure.

Subsequently, a phase is provided whereby a structure 10 is obtained by molding a shell portion 101 which defines a pressure chamber 12 which is subjected to the pulsating pressure of alternating intake and delivery of the pump in which the frame 9 is positioned in a mold on appropriate references corresponding to the attachment points 4 and to the fastening element 7.

With the injection of thermoplastic material into the mold, the frame 9 is buried into the structure 10 with the exception of the front of the attachment points 4 and of the fastening elements 7.

A head 1 is thereby obtained with high chemical and mechanical resistance, in which the pumped liquids are in contact only with the resin, or plastic, part of the head 1 which is not permeable thanks to the high coating thickness of the structure 10.

What is claimed is:

1. A head (1) for an alternating pump for fluids, having an inlet section (2) and an outlet section (3) fort the entry and exit of the pumped fluid, comprising:

a rigid structure (10) made of plastic material and comprising a shell portion (101) defining a pressure chamber (12) between the inlet section (2) and the outlet section 93), the pressure chamber (12) being subjected to the pulsating pressure due to the alternation of intake and delivery of the pump;

a metal frame (9) integrated in the rigid structure (10), the frame comprising points (4) for the attachment of intake and delivery manifolds (5, 6), elements (7) for fastening the head (1) to a base (8) and ribs (11) for connecting the attachment points (4) to the fastening elements (7), the ribs (11) being integrated in the shell portion (101).

2. A head as claimed in claim 1, wherein the inlet section (2), or the outlet section (3), or both sections, comprise a semitubular portion (9*a*) of the metal frame (9) integrated into a tubular portion (10*a*) of the rigid structure (10).

3. A head as claimed in claim 1, wherein the attachment points (4) and the fastening elements (7) are buried into the rigid structure (10), but the front of said attachment points and the front of said fastening elements are uncovered, in particular they are not covered by the plastic material of the rigid structure.

4. An alternating pump for fluids, comprising a head (1) as claimed in any of the previous claims.

* * * * *